US009661976B2

(12) United States Patent
Barrocas et al.

(10) Patent No.: US 9,661,976 B2
(45) Date of Patent: May 30, 2017

(54) MULTI-FUNCTIONAL CLEANING SYSTEM

(71) Applicant: EURO-PRO OPERATING LLC, Newton, MA (US)

(72) Inventors: Mark A. Barrocas, Chestnut Hill, MA (US); Jason Boyd Thorne, Wellesley Hills, MA (US); Alexander J. Calvino, Cranston, RI (US)

(73) Assignee: SHARKNINJA OPERATING LLC, Boston, MA (US)

( * ) Notice: Subject to any disclaimer, the term of this patent is extended or adjusted under 35 U.S.C. 154(b) by 338 days.

(21) Appl. No.: 13/261,828

(22) PCT Filed: Sep. 24, 2012

(86) PCT No.: PCT/US2012/056796
§ 371 (c)(1),
(2) Date: Mar. 14, 2014

(87) PCT Pub. No.: WO2013/044196
PCT Pub. Date: Mar. 28, 2013

(65) Prior Publication Data

US 2014/0283328 A1 Sep. 25, 2014

Related U.S. Application Data

(60) Provisional application No. 61/537,679, filed on Sep. 22, 2011.

(51) Int. Cl.
*A47L 11/40* (2006.01)
*A47L 13/22* (2006.01)
(Continued)

(52) U.S. Cl.
CPC ..... *A47L 13/225* (2013.01); *A47L 5/28* (2013.01); *A47L 9/325* (2013.01); *A47L 11/34* (2013.01);
(Continued)

(58) Field of Classification Search
CPC ..... A47L 9/02–9/08; A47L 11/4086
See application file for complete search history.

(56) References Cited

U.S. PATENT DOCUMENTS 5,613,271 A * 3/1997 Thomas ..... A47L 7/0009 15/321
6,736,873 B2 5/2004 Conrad et al.
(Continued)

FOREIGN PATENT DOCUMENTS

RU 2302810 C2 7/2007

OTHER PUBLICATIONS http://www.sharkclean.com/rotator/steam-or-vac-mv3010/, printed Jan. 22, 2014 (two (2) pages).

*Primary Examiner* — Larry E Waggle, Jr.
*Assistant Examiner* — Henry Hong
(74) *Attorney, Agent, or Firm* — Ntellect Law, P.C.

(57) ABSTRACT

A multi-functional cleaning system usable as both a vacuum cleaner and a steam cleaner includes (a) a body having a motor assembly for generating suction and a dust collector for collecting foreign matters, (b) a first cleaning head, such as a vacuum nozzle, detachably coupleable to the body and having an inlet for directing the foreign matters into the dust collector, and (c) a second cleaning head, such as a steam cleaning head, detachably coupleable to the body and having an outlet for directing steam onto a surface. Attaching the body to the first cleaning head forms a vacuum cleaner configuration. while attaching the body to the second cleaning head forms a steam cleaner configuration. Electrical wiring and connectors enable operation of the blower motor only in the vacuum cleaner configuration, and include protection against water ingress that can cause malfunctioning or create a safety hazard.

3 Claims, 19 Drawing Sheets

(51) Int. Cl.
*A47L 5/28* (2006.01)
*A47L 9/32* (2006.01)
*A47L 11/34* (2006.01)

(52) U.S. Cl.
CPC ..... *A47L 11/4083* (2013.01); *A47L 11/4086* (2013.01); *A47L 11/4088* (2013.01)

(56) References Cited

U.S. PATENT DOCUMENTS

| | | | | |
|---|---|---|---|---|
| 6,865,773 | B2 | 3/2005 | Tsen | |
| 6,874,197 | B1 | 4/2005 | Conrad et al. | |
| 7,917,991 | B2 | 4/2011 | Chung et al. | |
| 8,458,850 | B2 | 6/2013 | Kasper et al. | |
| 8,627,543 | B2 * | 1/2014 | Vrdoljak | A47L 9/0686 15/319 |
| 9,179,815 | B2 * | 11/2015 | Davidshofer | A47L 13/254 |
| 2007/0124891 | A1 * | 6/2007 | Lee | A47L 9/06 15/320 |
| 2008/0066789 | A1 | 3/2008 | Rosenzweig et al. | |
| 2009/0000051 | A1 | 1/2009 | Rosenzweig et al. | |
| 2009/0320231 | A1 | 12/2009 | Rosenzweig et al. | |
| 2010/0024146 | A1 | 2/2010 | Rosenzweig et al. | |
| 2010/0199455 | A1 | 8/2010 | Vrdoljak | |
| 2010/0236018 | A1 | 9/2010 | Vrdoljak et al. | |
| 2010/0251505 | A1 | 10/2010 | Vrdoljak et al. | |
| 2010/0287716 | A1 | 11/2010 | Kasper et al. | |
| 2012/0110775 | A1 * | 5/2012 | Krebs | A47L 9/0422 15/347 |
| 2012/0118326 | A1 * | 5/2012 | Schumacher | A47L 9/02 134/21 |
| 2014/0237767 | A1 * | 8/2014 | Conrad | A47L 9/2857 15/353 |

* cited by examiner

MULTI-FUNCTIONAL CLEANING SYSTEM

BACKGROUND

The present invention is related to the field of cleaning apparatuses such as vacuum cleaners and steam cleaners, and in particular to cleaning apparatuses providing both vacuum cleaning and steam cleaning functionality.

Bothe steam cleaners and vacuum cleaners are known. Examples of steam appliances include those disclosed in U.S. Patent Application Nos. 2009/0320231 and U.S. Patent Application No. 2008/0066789, filed Jun. 27, 2008 and Jun. 27, 2007. Examples of vacuum cleaners include those disclosed in U.S. Pat. Nos. 6,736,873 and 6,874,197, issued May 18, 2004 and Apr. 5, 2005, respectively.

A versatile combination steam mop and vacuum has previously been introduced in a product known as Shark® Vac-Then-Steam® MV2010. Consumers have responded well to the MV2010, and would like even greater versatility and performance.

SUMMARY

A multi-functional cleaning system capable of serving as both a vacuum cleaner and a steam cleaning appliance is disclosed. In one embodiment, an apparatus includes (a) a body having a motor assembly for generating suction force and a dust collecting unit for collecting foreign matters, (b) a first cleaning head detachably coupleable to the body, the first cleaning head having an inlet for directing the foreign matters into the dust collecting unit, and (c) a second cleaning head detachably coupleable to the body, the second cleaning head having an outlet for directing steam onto a surface. By alternating between the two cleaning heads, the multi-functional cleaning apparatus can be used as a vacuum cleaner or as a steam mop.

In one embodiment, the motor assembly includes an electric blower (also referred to as a blower motor herein). In another embodiment, the dust collecting unit is capable of filtering the foreign matters. In some embodiments, the first cleaning head is a vacuum nozzle. In one example, when the first cleaning head and the body are combined, the multi-functional cleaning apparatus can be used and operated as a vacuum cleaner.

In one embodiment, the second cleaning head is a steam cleaning head including a steam generator for generating steam. In another embodiment, the second cleaning head includes a water storage unit for supplying water to the steam generator. In one example, when the second cleaning head and the body are combined, the multi-functional cleaning apparatus can be used and operated as a steam appliance. For example, the steam appliance may be a steam mop.

In some embodiments, the multi-functional cleaning apparatus includes a pad in fluid communication with the outlet of the second cleaning head for distributing steam onto the surface.

In one embodiment, a multi-functional cleaning system includes: (a) a body having a motor assembly for generating suction force and a dust collecting unit for collecting foreign matters, (b) a first cleaning head detachably coupleable to the body, the first cleaning head having an inlet for directing the foreign matters into the dust collecting unit, and (c) a second cleaning head detachably coupleable to the body, the second cleaning head having a steam generator for generating steam, a water storage unit for supplying water to the steam generator, and an outlet for directing steam onto a surface.

In one embodiment, the motor assembly is an electric blower. In another embodiment, the dust collecting unit is capable of filtering the foreign matters. In some embodiments, the first cleaning head is a vacuum nozzle. In one configuration, when the first cleaning head and the body are combined, the multi-functional cleaning system is a vacuum cleaner. In one configuration, when the second cleaning head and the body are combined, the multi-functional cleaning system is a steam appliance such as a steam mop.

In one embodiment, the multi-functional cleaning system includes a pad in fluid communication with the outlet of the second cleaning head for distributing steam onto the surface.

In one embodiment, a multi-functional cleaning system includes: (a) a body having a motor assembly for generating suction force and a dust collecting unit for filtering and collecting foreign matters, (b) a first cleaning head detachably coupleable to the body, the first cleaning head having an inlet for directing the foreign matters into the dust collecting unit, wherein the first cleaning head and the body are combinable to operate as a vacuum cleaner, and (c) a second cleaning head detachably coupleable to the body, the second cleaning head having a steam generator for generating steam, a water storage unit for supplying water to the steam generator, and an outlet for directing steam onto a surface, wherein the second cleaning head and the body are combinable to operate as a steam appliance.

In one embodiment, the steam appliance is a steam mop. In another embodiment, the multi-functional cleaning system includes a pad in fluid communication with the outlet of the second cleaning head for distributing steam onto the surface.

Other variations, embodiments and features of the present disclosure may become more evident from the following detailed description and drawings.

BRIEF DESCRIPTION OF THE DRAWINGS

The foregoing and other objects, features and advantages will be apparent from the following description of particular embodiments of the invention, as illustrated in the accompanying drawings in which like reference characters refer to the same parts throughout the different views. The drawings are not necessarily to scale, emphasis instead being placed upon illustrating the principles of various embodiments of the invention.

DETAILED DESCRIPTION

It will be appreciated by those of ordinary skill in the art that the disclosure can be embodied in other specific forms without departing from the spirit or essential character thereof. The presently disclosed embodiments are therefore considered in all respects to be illustrative and not restrictive.

Figure 1:
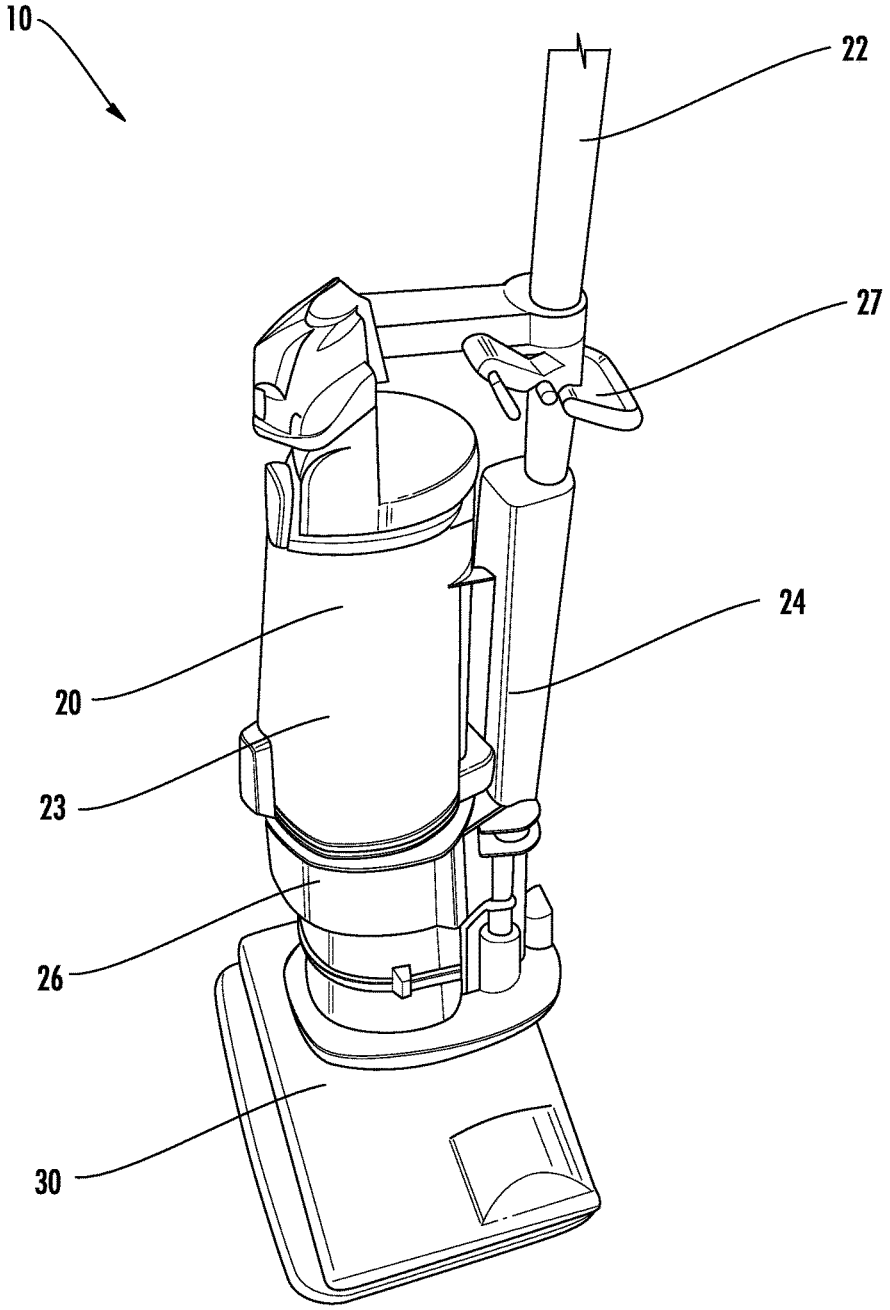
FIG. 1 is a isometric view of one configuration of a multi-functional cleaning system according to one embodiment of the present disclosure.

FIG. 1 is a isometric view of one configuration of a multi-functional cleaning system 10 according to one embodiment of the present disclosure. The multi-functional cleaning system 10, in one configuration, can function as a floor cleaning apparatus such as that of a steam appliance (e.g., steam mop). Examples of steam appliances include those disclosed in U.S. Patent Application Nos. 2009/0320231 and U.S. Patent Application No. 2008/0066789, filed Jun. 27, 2008 and Jun. 27, 2007, respectively, each of which is incorporated herein by reference in its entirety for all purposes.

In general, the multi-functional cleaning system 10 includes an apparatus 10 having a body 20. The body 20 includes a motor assembly 26 for generating suction force and a dust collecting unit 23 for collecting foreign matters. In operation, when the apparatus 10 is configured as a steam appliance, the motor assembly 26 and the dust collecting unit 23 are not operable.

In this configuration, the apparatus 10 includes a cleaning head 30 that can be detachably coupled to the body 20. The coupling mechanism may include a mechanical latch 24 with an actuable member 27 for coupling and decoupling the cleaning head 30 and the body 20. A pole 22 may be coupled to the body 20 facilitate ease of maneuvering for operating the cleaning head 30. The cleaning head 30 includes an outlet for directing steam onto a floor surface. This will be discussed in more detail below.

Figure 2:
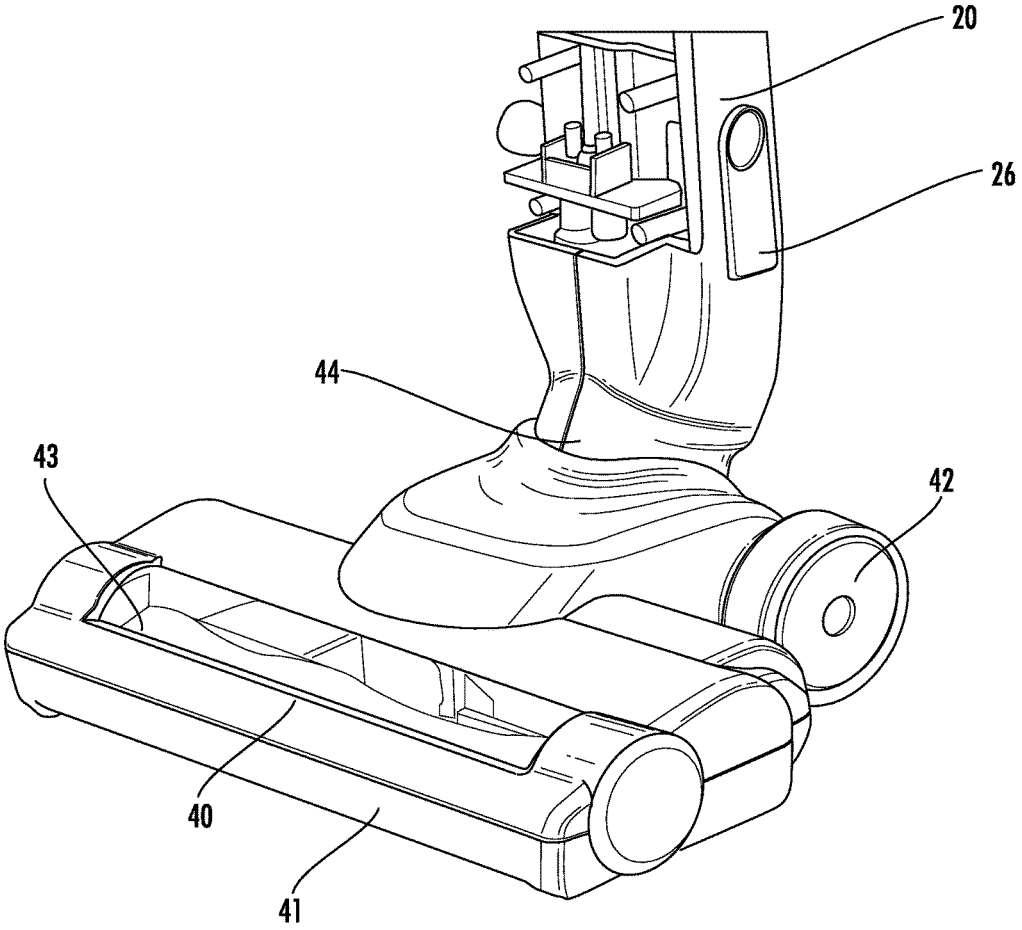
FIG. 2 is a schematic view of one configuration of a multi-functional cleaning system according to one embodiment of the present disclosure.

FIG. 2 is a schematic view of one configuration of a multi-functional cleaning system'10 according to one embodiment of the present disclosure. The multi-functional cleaning system 10, in this configuration, can function as a floor cleaning apparatus such as that of a vacuum cleaner. Examples of vacuum cleaners include those disclosed in U.S. Pat. Nos. 6,736,873 and 6,874,197, issued May 18, 2004 and Apr. 5, 2005, respectively, each of which is incorporated herein by reference in its entirety for all purposes.

As discussed above, the multi-functional cleaning system 10 includes an apparatus 10 having a body 20. The body 20 includes a motor assembly 26 for generating suction force and a dust collecting unit 23 for collecting foreign matters (best illustrated in FIG. 1). In operation, when the apparatus 10 is configured as a vacuum cleaner, the motor assembly 26 and the dust collecting unit 23 are operational.

In one embodiment, the motor assembly 26 is an electric blower. In some embodiments, the motor assembly 26 can be any electrical and/or mechanical device capable of providing suction. The energy for powering the motor assembly 26 can be provided by an electrical outlet (not shown). The electricity may also be used for powering the multi-functional cleaning system 10 including when the apparatus 10 is used as a steam appliance. This will be discussed in more detail below.

In one embodiment, in addition to collecting dirt, dust or other foreign particles from a floor surface, the dust collecting unit 23 is also capable of filtering the foreign matters.

In the configuration as shown in FIG. 2, the apparatus 10 includes a cleaning head 40 that can be detachably coupled to the body 20. The apparatus 10, in the vacuum configuration, may be maneuvered about a floor surface using the pole 22. The coupling mechanism may be similar to the mechanical latch 24 described above.

In the alternative, the coupling mechanism may be other electrical, mechanical or electro-mechanical latching mechanisms. In some embodiments, the latch 24 may allow a user to lift and detach the cleaning head 30, 40 at the same time. In other embodiments, the latch 24 may include a releasable lock. In yet some instances, the latch 24 may also be used as a carrying handle.

In this configuration, the cleaning head 40 includes an inlet 41 for directing the foreign matters into the dust collecting unit'23. In one embodiment, the cleaning head 40 can have substantially similar properties and/or components as that of a vacuum cleaner nozzle.

In addition to the downwardly facing suction inlet 41, the cleaning head 40 may include a brush bar 43 adjacent the inlet 41 for agitating the floor surface. The cleaning head 40 may also be pivotally mounted to the body 20 along with a swivel mechanism 44 allowing for better maneuverability. Support wheels 42 may also be mounted to either side of the cleaning head 40 for supporting the cleaning head 40 and allowing movement across a floor surface.

Figure 3:
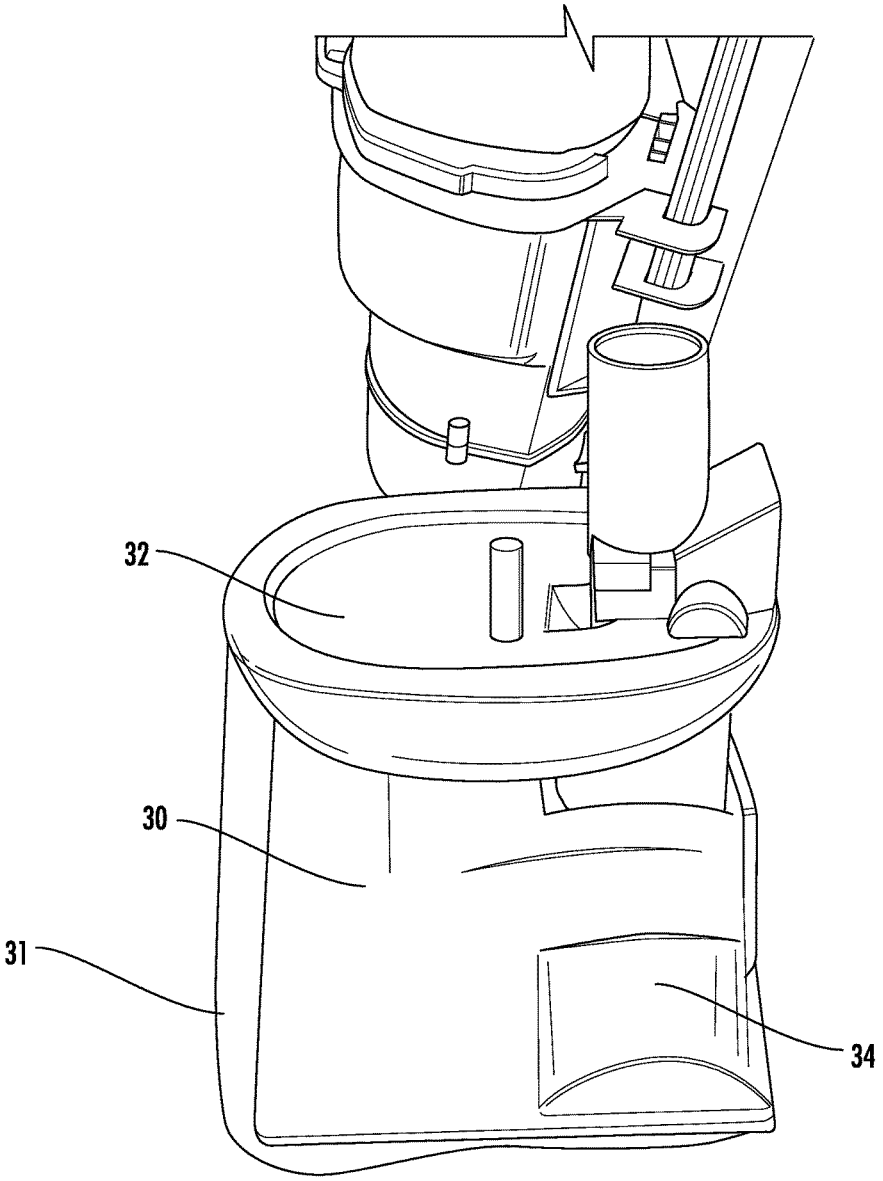
FIG. 3 is a isometric view of a cleaning head for a multi-functional cleaning system according to one embodiment of the present disclosure.

FIG. 3 is a isometric view of a cleaning head 30 for a multi-functional cleaning system 10 according to one embodiment of the present disclosure. In this instance, the cleaning head 30 may be coupled to the body 20 allowing the cleaning apparatus 10 to be used as a steam appliance such as that of a steam mop.

In one embodiment, the cleaning head 30 may be substantially similar to that of a steam frame or a steam attachment. Examples of steam attachments include the likes of those disclosed in U.S. Patent Application Nos. 2010/0269282 and 2010/0272948, each of which is filed May 15, 2009 and incorporated herein by reference in its entirety for all purposes.

To operate as a steam mop, the cleaning head 30 includes a steam generator embedded within the Cleaning head 30, where the steam generator is capable of generating steam. This will be described in more detail in subsequent figures and discussion. Water can be supplied to the steam generator from a water storage unit 32 on the cleaning head 30.

Operation of the steam appliance can be triggered by an on/off button 34 on the upper surface of the cleaning head 30.

In one embodiment, the cleaning head 30 includes a pad 31 in fluid communication with the outlet for distributing steam onto the floor surface for purposes of steam cleaning. In that instance, the outlet may be substantially covered by the pad 31.

Examples of pads 31 or materials/layers suitable for serving as a cover for the steam cleaning head 30 include those disclosed in U.S. Patent Application Nos. 2009/0000051 and 2010/0024146, filed Mar. 7, 2008 and Aug. 4, 2008, respectively, each of which is incorporated herein by reference in its entirety for all purposes.

Figure 4:
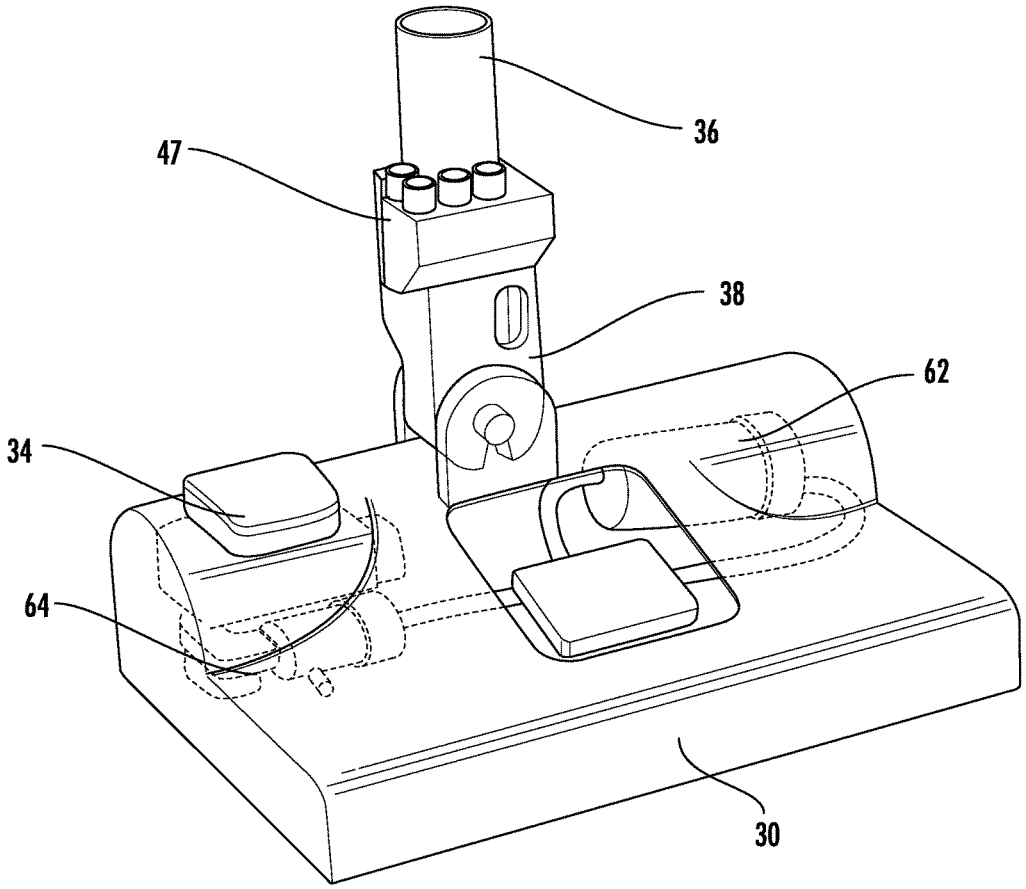
FIG. 4 is a schematic view of a cleaning head for a multi-functional cleaning system according to one embodiment of the present disclosure.

FIG. 4 is a schematic view of a cleaning head 30 for a multi-functional cleaning system 10 according to one embodiment of the present disclosure. The cleaning head 30 includes an actuable button 34 for turning the cleaning head 30 on and off. In addition, the power button 34 for the cleaning head 30 may also be responsible for turning on a pump 64 for pumping water from the water tank 32 to a steam generator 62. In one embodiment, the pump 64 can be electrically powered. In the alternative, the pump 64 can be mechanically powered by movement of the body 20 and the cleaning head 30. In some instances, mechanical power may require the use of piston pumps or the like (not shown).

When water supplied from the water tank 32 is pumped into the steam generator 62, the water can be converted to steam and subsequently discharged or dispersed from the outlet at the bottom of the cleaning head 30. The outlet can be a single opening, multiple openings, or a manifold, among other suitable configurations.

The cleaning head 30 includes a connector 36 for easier coupling to the body 20 and the corresponding pole 22. In addition, the cleaning head 30 may also include a universal swivel 38 for greater flexibility and movement of the steam mop across a floor surface.

The power for powering the pump 64 and the steam generator 62 may be supplied from the wall outlet as described above, via a plurality of electrical connections 47. In steam appliance mode, electricity from the wall outlet can be provided from the body 20 through the electrical connections 47, to provide the necessary power to the pump 64 and the steam generator 62 for the production of steam. Additional safety feature may be triggered by the on/off button 34 on the cleaning head 30.

In one embodiment, the cleaning head 40 for vacuum mode may include similar electrical connections 47. In vacuum cleaner mode, electricity from the wall outlet can be provided to power the motor assembly 26. In addition, when the cleaning head 40 is coupled to the body 20, the electrical connections 47 can supply power for driving the brush bar 43. An on/off button can be mounted on the pole 22 and/or portions of the body 20 to allow a user to turn on and off the vacuum.

Because of the multiple electrical connections 47 on both the cleaning heads 30, 40, the multi-functional cleaning system 10 can detect the correct cleaning head 30, 40 that is mounted so as to prevent accidental power being supplied to the motor assembly 26 while the steam cleaning head 30 is mounted. For example, an additional feedback mechanism may be added so that the motor assembly 26 does not turn on unless a feedback is detected from the brush bar. In other words, the power from the wall outlet does not power the motor assembly 26 directly but rather is supplied to the brush bar before feedback to the motor assembly 26 so as to prevent the motor assembly 26 from accidentally turning on when the steam cleaning head 30 is mounted. Disclosed above is one example of a safety mechanism. It will be appreciated by one skilled in the art that additional or different safety mechanisms may be implemented.

Figure 5:
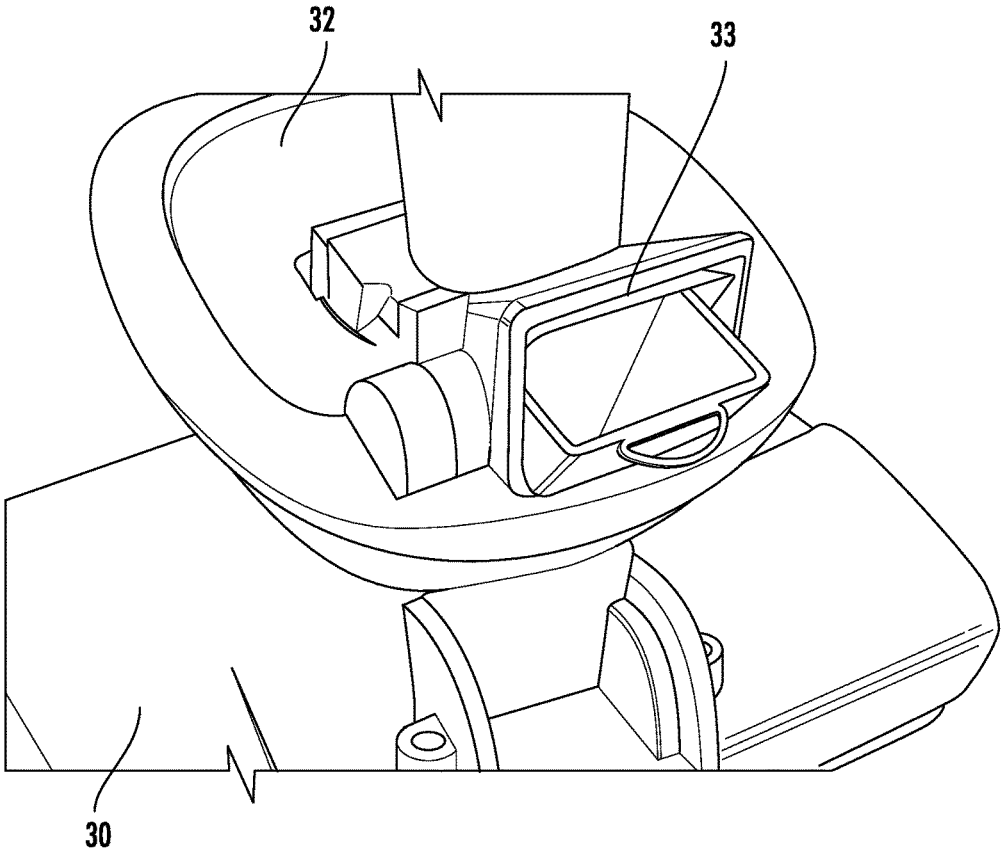
FIG. 5 is a rear isometric view of the cleaning head of FIG. 3.

FIG. 5 is a rear isometric view of the cleaning head 30 of FIG. 3. In this instance, water can be added to the water storage unit 32 via an opening 33. In other embodiments, the water tank or water storage unit 32 may be modular and can be removably detached from the cleaning head 30.

Figure 6:
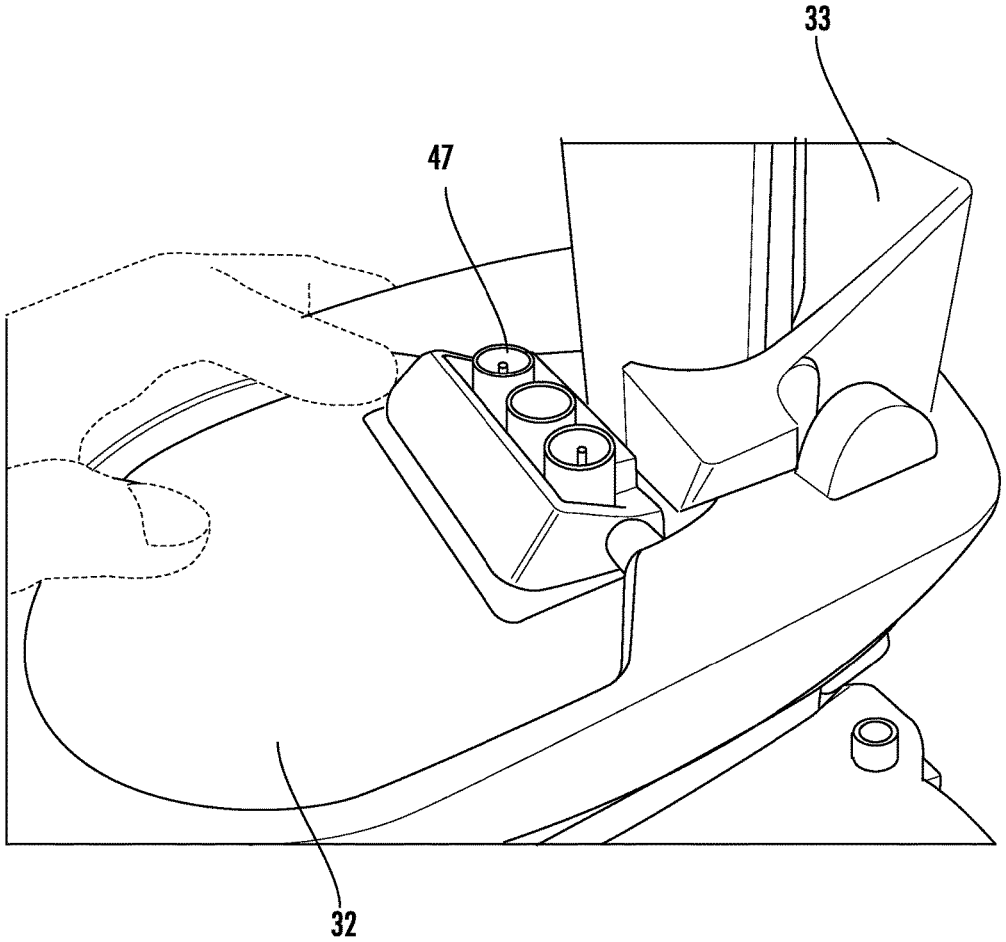
FIG. 6 is a front isometric view of the cleaning head of FIG. 3.

FIG. 6 is a front isometric view of the cleaning head 30 of FIG. 3 better showing the electrical connections 47, the water tank 32 and the water fill opening 33 of the water tank 32.

Figure 7:
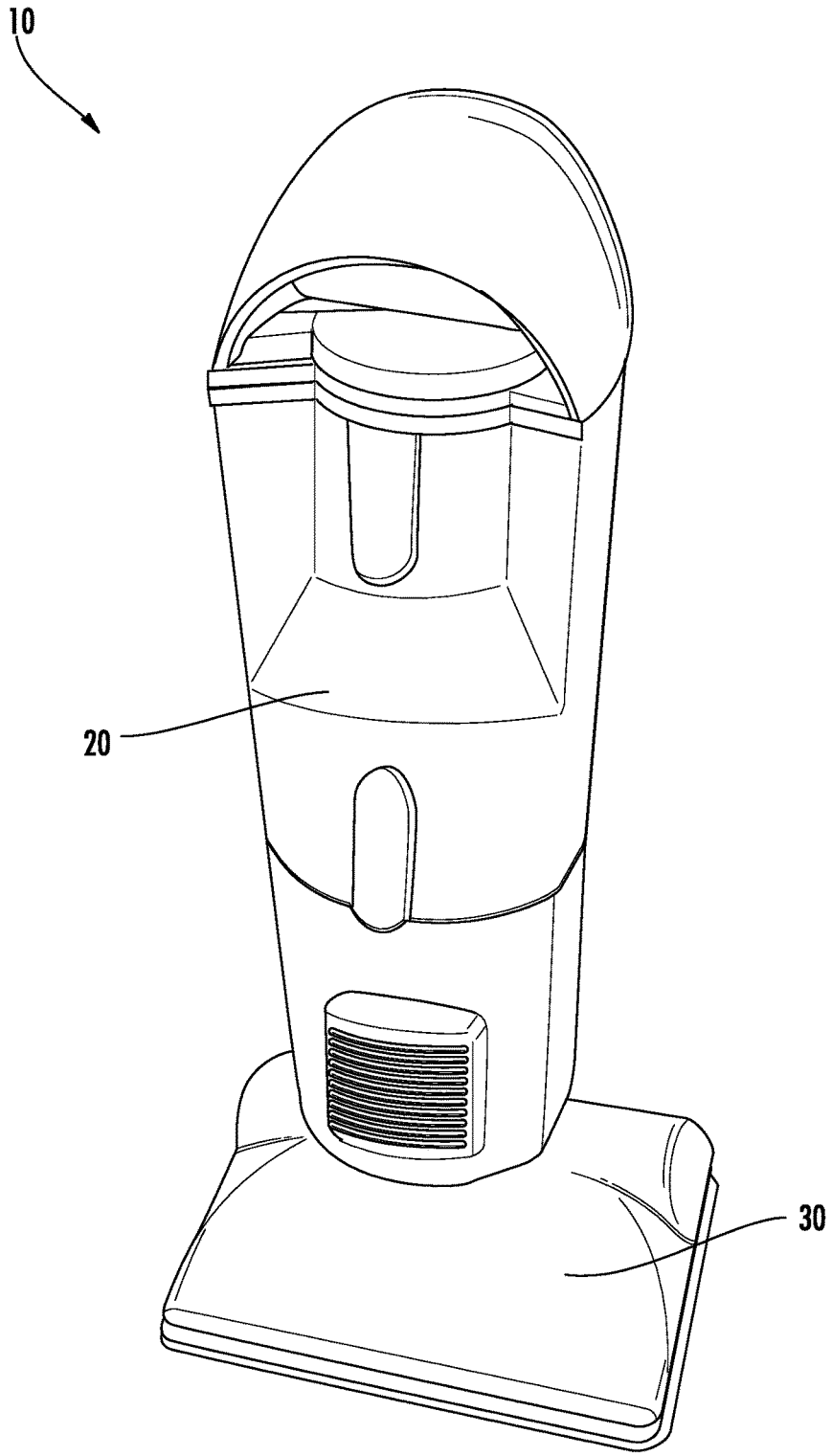
FIG. 7 is a isometric view of one configuration of a multi-functional cleaning system according to one embodiment of the present disclosure.

FIG. 7 is a isometric view of one configuration of a multi-functional cleaning system 10 according to one embodiment of the present disclosure. As shown, the cleaning head 30 can be removably coupled to the body 20 to function as a vacuum cleaner or as a steam mop.

In one embodiment, when the multi-functional cleaning apparatus is configured as a vacuum cleaner, the cleaning head 40 can include a pad (not shown) mounted to the bottom thereof along with a suction inlet.

Figure 8:
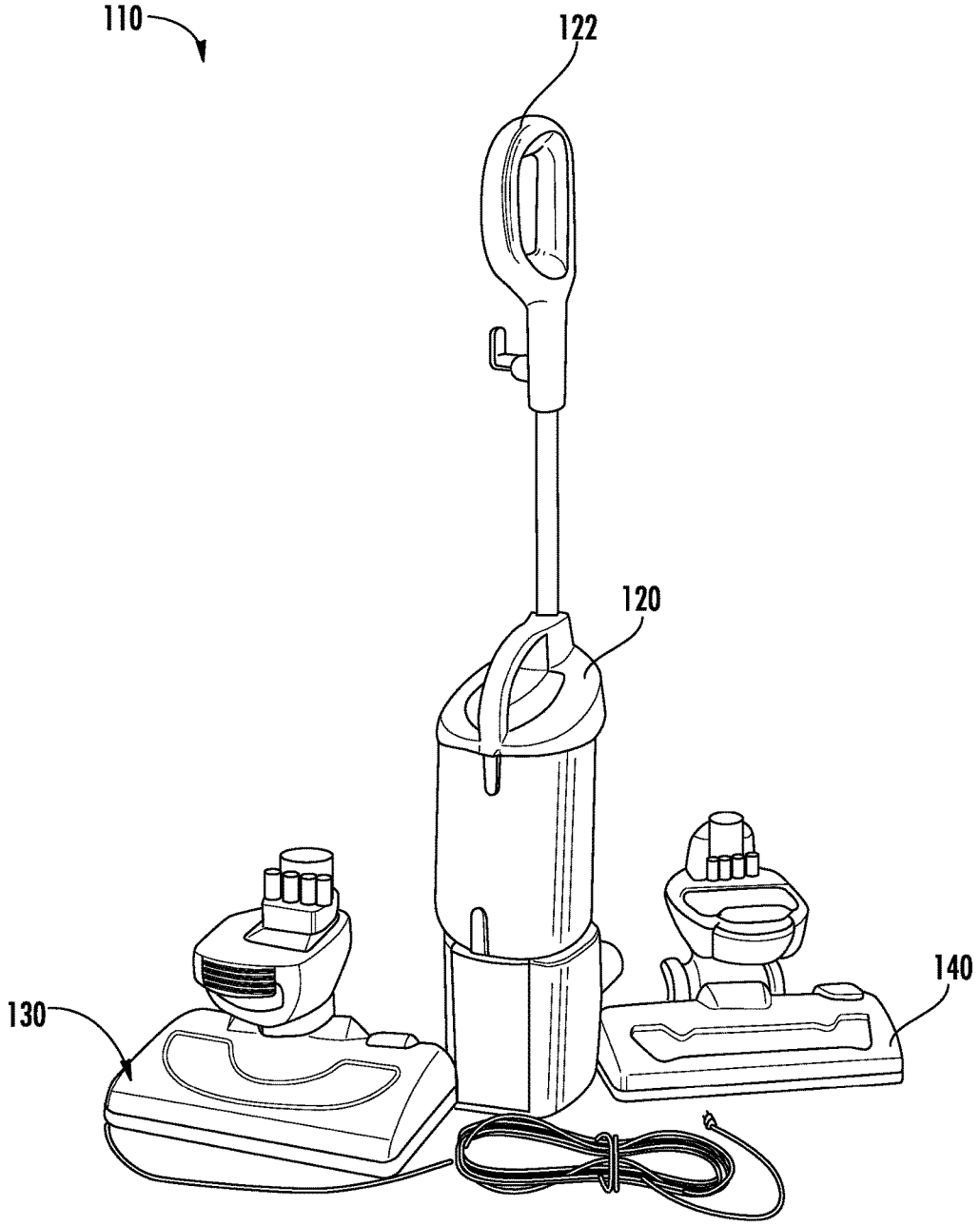
FIG. 8 is an isometric view of a multifunctional cleaning system according to another embodiment.

FIG. 8 shows a multi-functional cleaning system 110 according to a second embodiment. Similar to the system 10, the system 110 includes a body 120 usable with two separate removable cleaning heads, a steam cleaning head 130 and a vacuum cleaning head 140. The body 120 includes an upward-extending handle assembly 122, which may be detachable. As shown, the body 120 may be of a design enabling it to be stood upright when not attached to either cleaning head 130, 140, a feature that may enhance convenient use especially when transitioning in operation between steam and vacuum cleaning.

Figure 9:
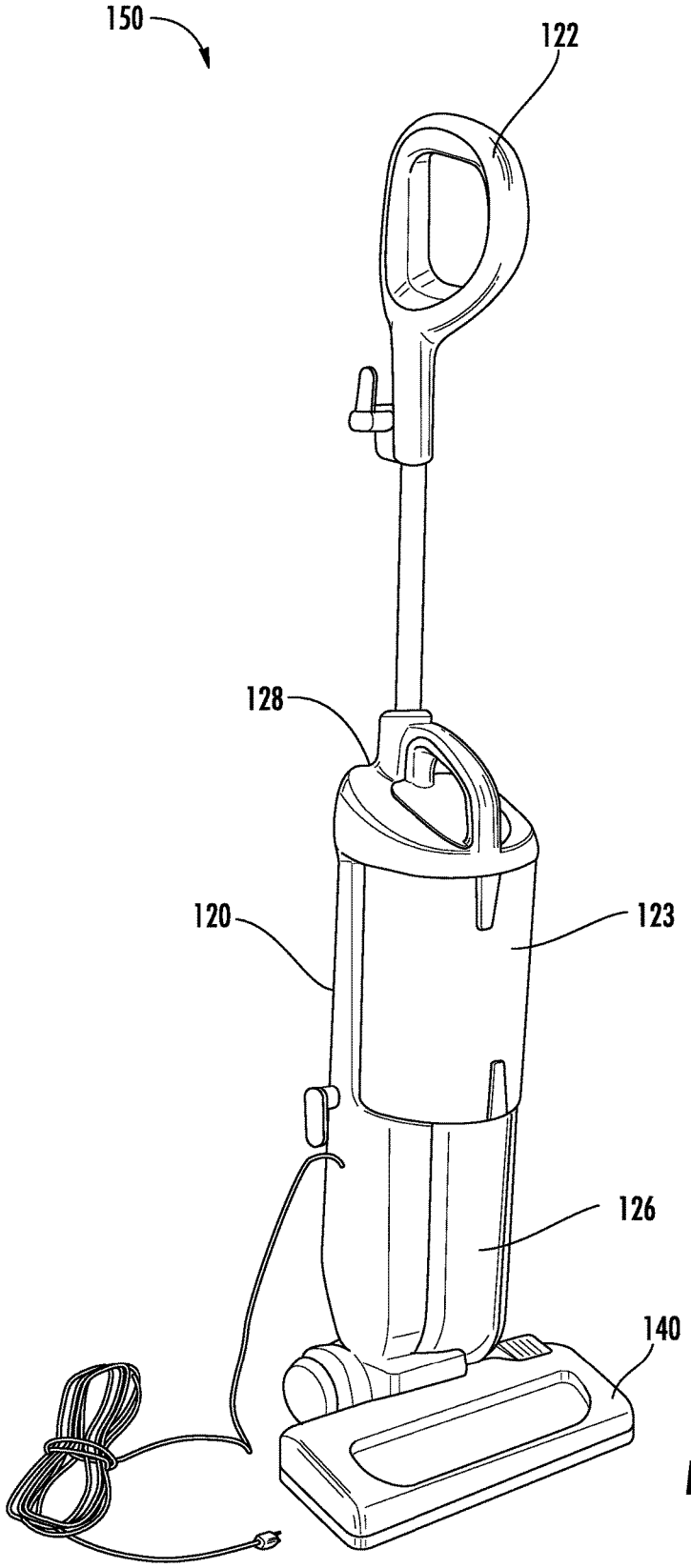
FIG. 9 is an isometric view of a vacuum cleaner configuration of the multifunctional cleaning system of FIG. 8.

FIG. 9 shows the cleaning system 110 arranged for vacuum cleaning by attachment of the vacuum cleaning head 140 to the body 120 to form an upright vacuum cleaner 150. Details of this attachment are described below. Similar to the body 20 of the embodiment of FIG. 1, the body 120 includes a dust collector 123, as well as a motor assembly 126 at a lower end of the body 120. Also shown is a dust cup release 128 that can be depressed by a user to release the dust collector 123.

Figure 10:
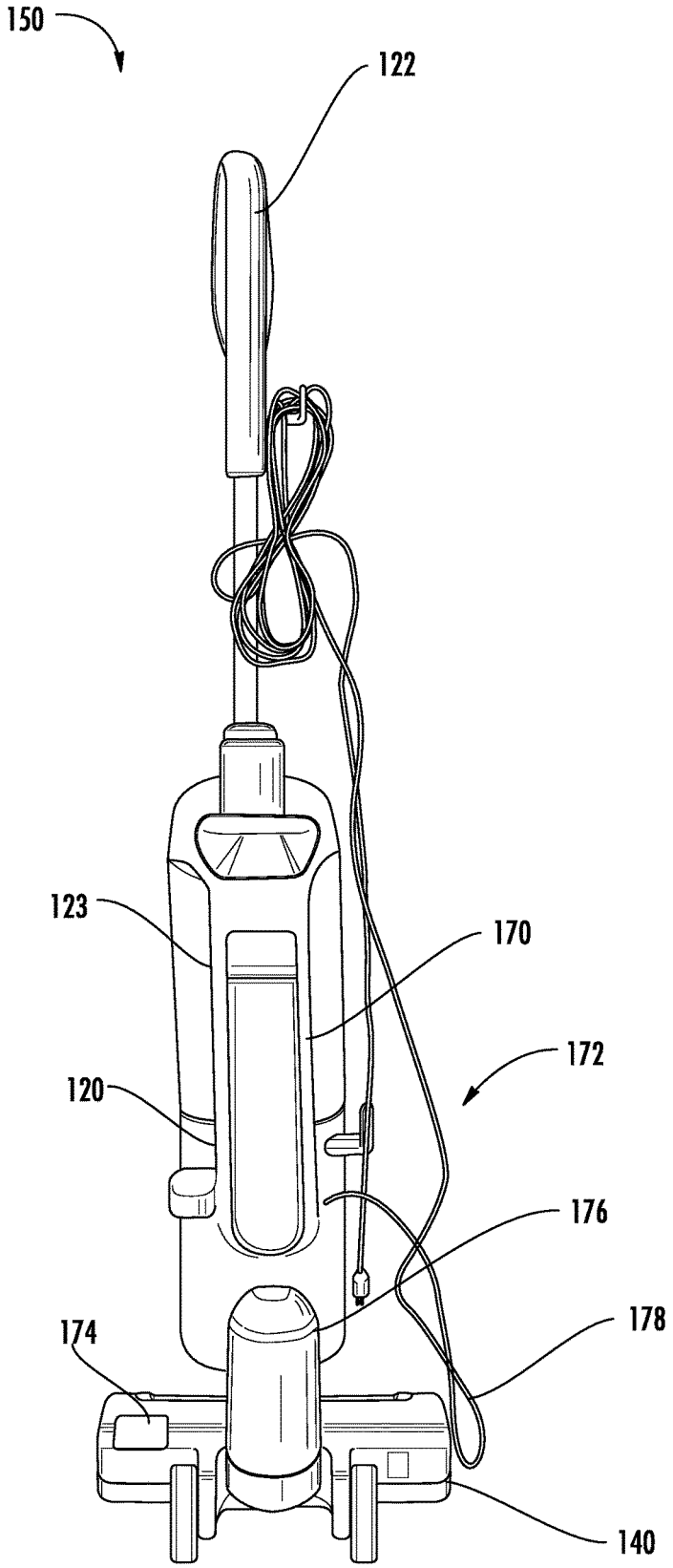
FIG. 10 is a rear orthographic view of the vacuum cleaner configuration of FIG. 9.

FIG. 10 is a rear view of the vacuum cleaner 150, showing a detachable hose 170 forming part of a suction airway of the body 120 along which intake air (generally dirty) travels during vacuum operation. At its upper end the hose 170 is connected to the body 120 at the top of the dust collector 123, at an opening (not shown) through which the intake air enters the dust collector 123. At its lower end the hose 170 is detachably coupled to an intake port of the body 120 that couples to an upward-facing tubular member of the vacuum cleaning head 140, as described in more detail below. When the hose 170 is detached, it may be connected to other vacuuming tools (not shown), generally hand-wielded and used for small areas (such as crevices, stairs, auto upholstery, etc.). The vacuum cleaning head 140 also includes a foot-actuated selector 174 used to control operation, for example to turn on/off a rotating beater bar in the vacuum cleaning head 140. Also shown in FIG. 10 is an AC power cord 172 which is fixedly attached to the body 120 at a lower section thereof. Details of internal wiring and connections are provided below.

The vacuum cleaning head 140 includes an up-facing tubular member 176 that is pivotally attached to a flat base 178 that is in contact with a surface such as a floor. The body 120 is rigidly attached to the tubular member 176 and thus can be pivoted in operation by use of the handle 122. This pivoting provides for the known operation of moving the vacuum cleaning head 140 forward and backward during a vacuuming operation while maintaining contact between the flat base 178 and the surface being cleaned.

Figure 11:
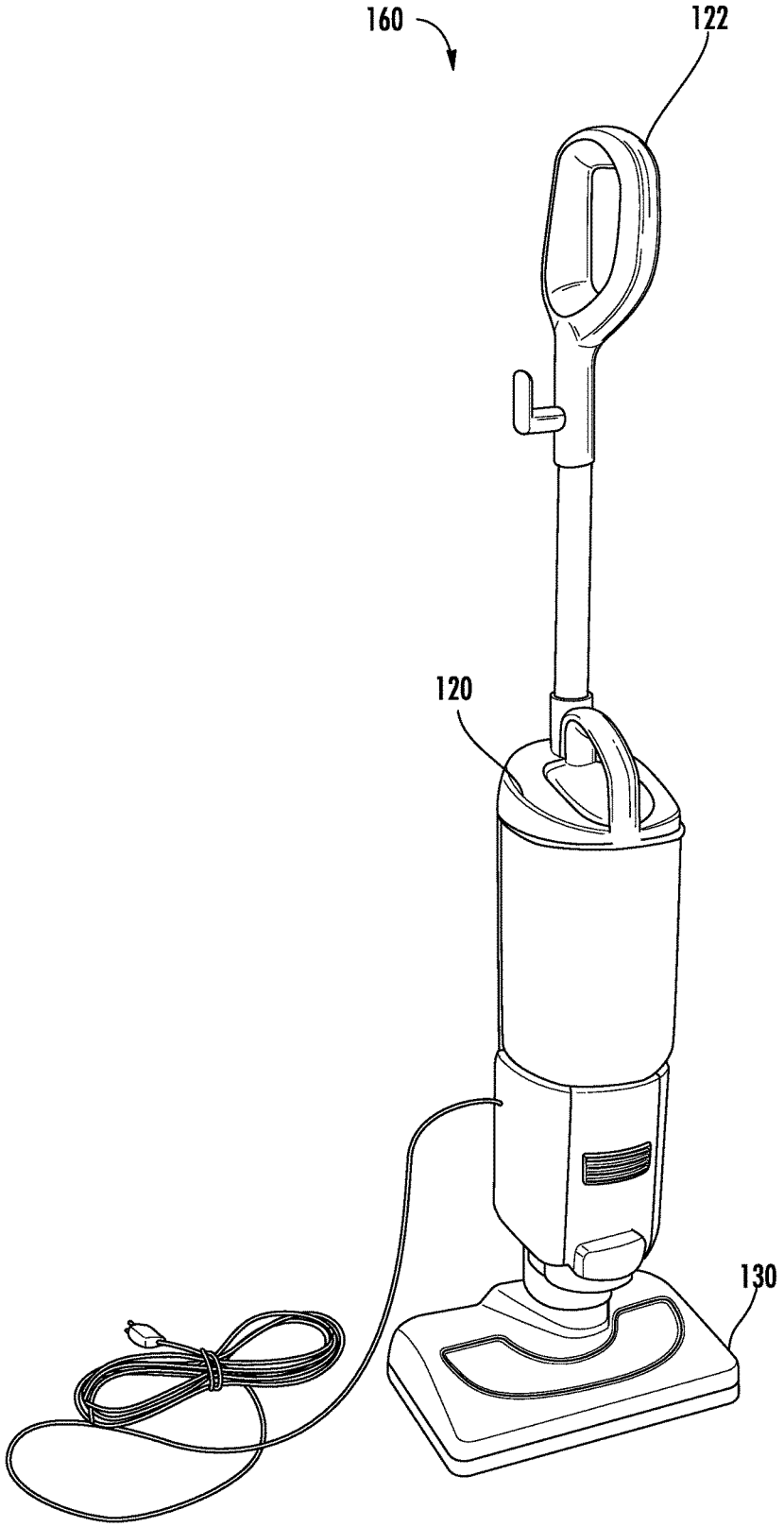
FIG. 11 is a isometric view of a steam cleaner configuration of the multifunctional cleaning system of FIG. 8.
Figure 12:
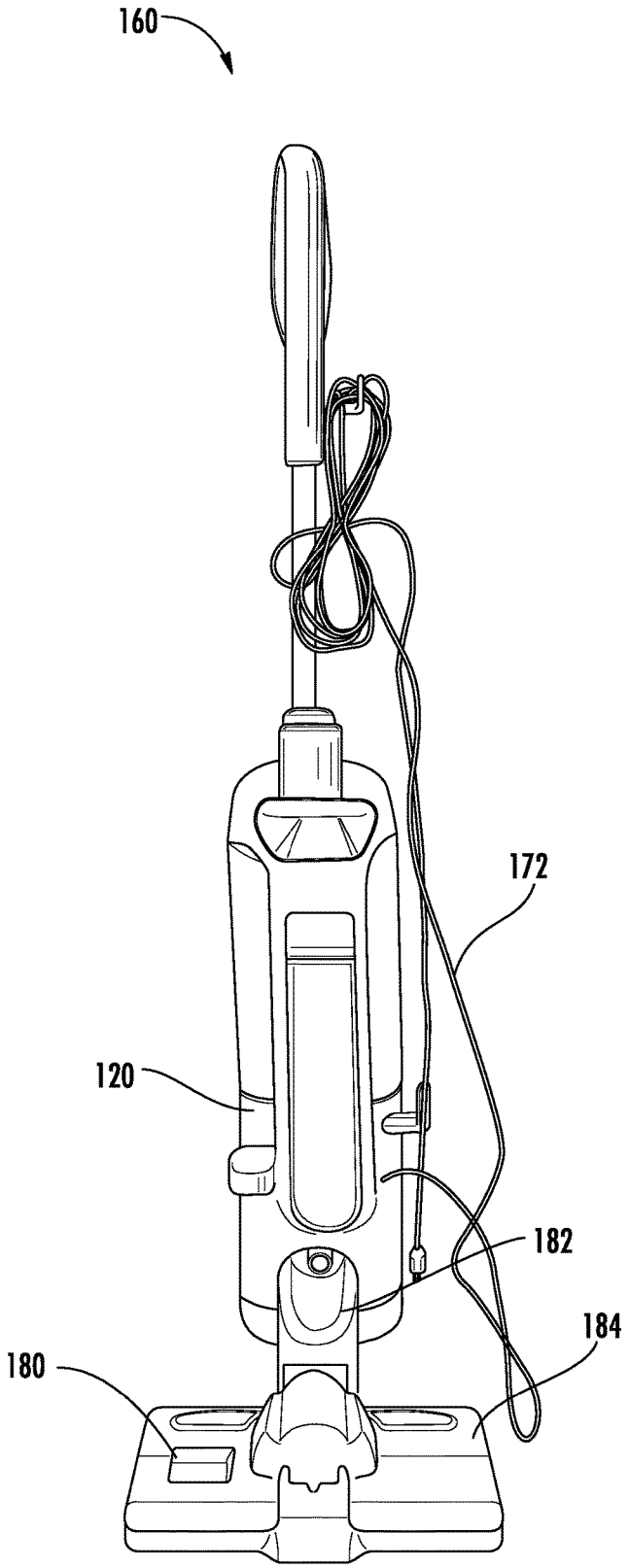
FIG. 12 is an rear orthographic view of the steam cleaner configuration of FIG. 11.

FIGS. 11-12 show the cleaning system 110 arranged for steam cleaning by attachment of the steam cleaning head 130 to the body 120 to form an upright steam cleaner 160, also referred to in some cases as a "steam mop". Details of this attachment are described below. By an arrangement also described below, in this configuration the vacuum motor in the body 120 is disabled. Wiring within the body 120 couples AC power from the power cord 172 to the steam cleaning head 130 to power a steam generator and other components therein, as also described in more detail below. Steam operation is controlled using a foot-actuated selector 180, for example to turn steam on or off and/or to select different rates of steam for different cleaning applications. Similar to the vacuum cleaning head 140, the steam cleaning head 130 has an up-facing tubular member 182 pivotally coupled to a flat base 184, providing for the same back-and-forth motion while maintaining contact between the base 184 and a surface being cleaned.

Figure 13:
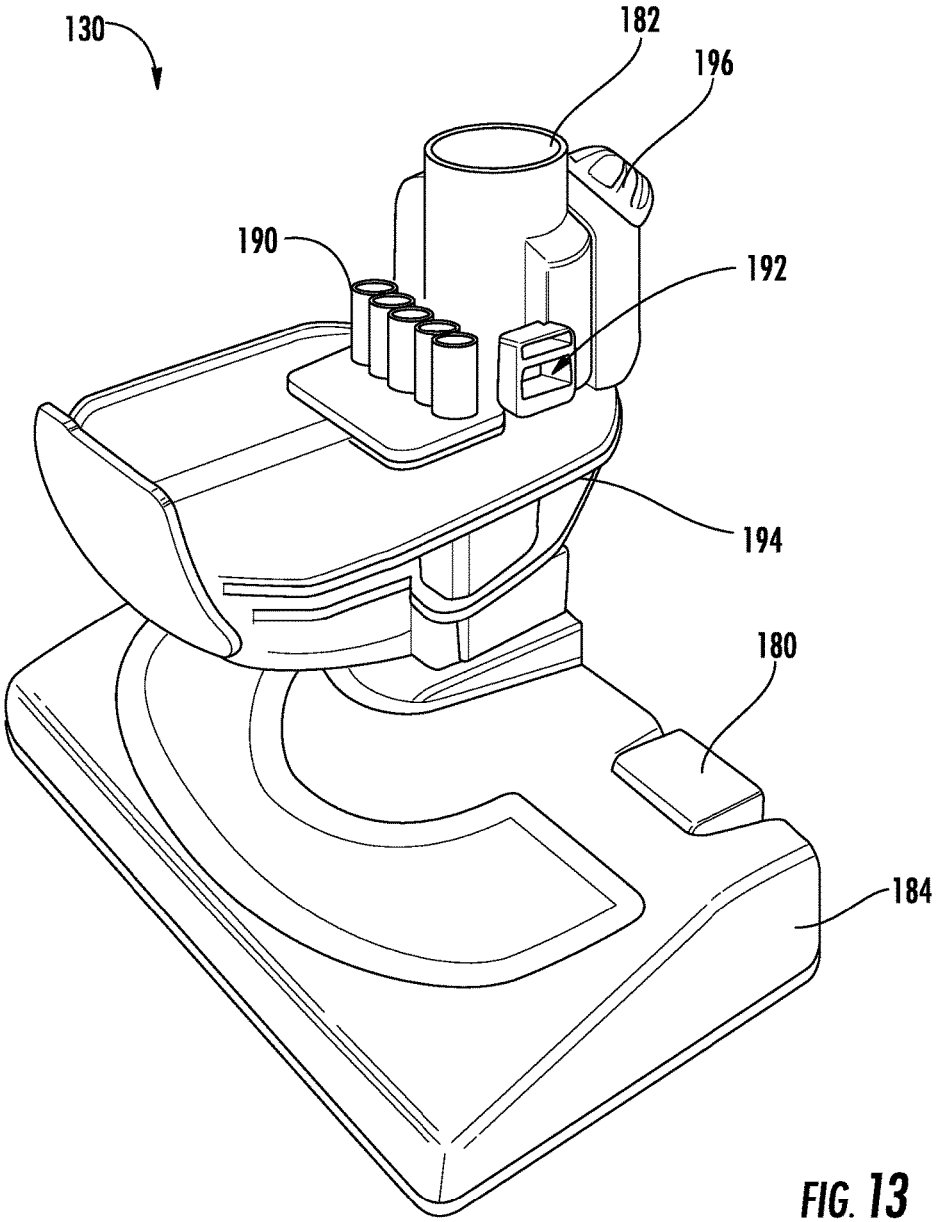
FIG. 13 is an isometric view of a steam cleaning head.

FIG. 13 shows the steam cleaning head 130 in more detail. The tubular member 182 includes structure supporting an electrical connector 190, as well as a hollow 192 for receiving a corresponding latch element from the body 120 that mechanically secures the body 120 to the steam cleaning head 130. Extending from this structure is a tank or reservoir 194 that holds water being provided to a steam generator within the base 184 during operation. The tank 194 includes a rear-facing fill opening covered by a fill cap 196. Details of the structure providing for flow of the water and steam are provided below.

Figure 14:
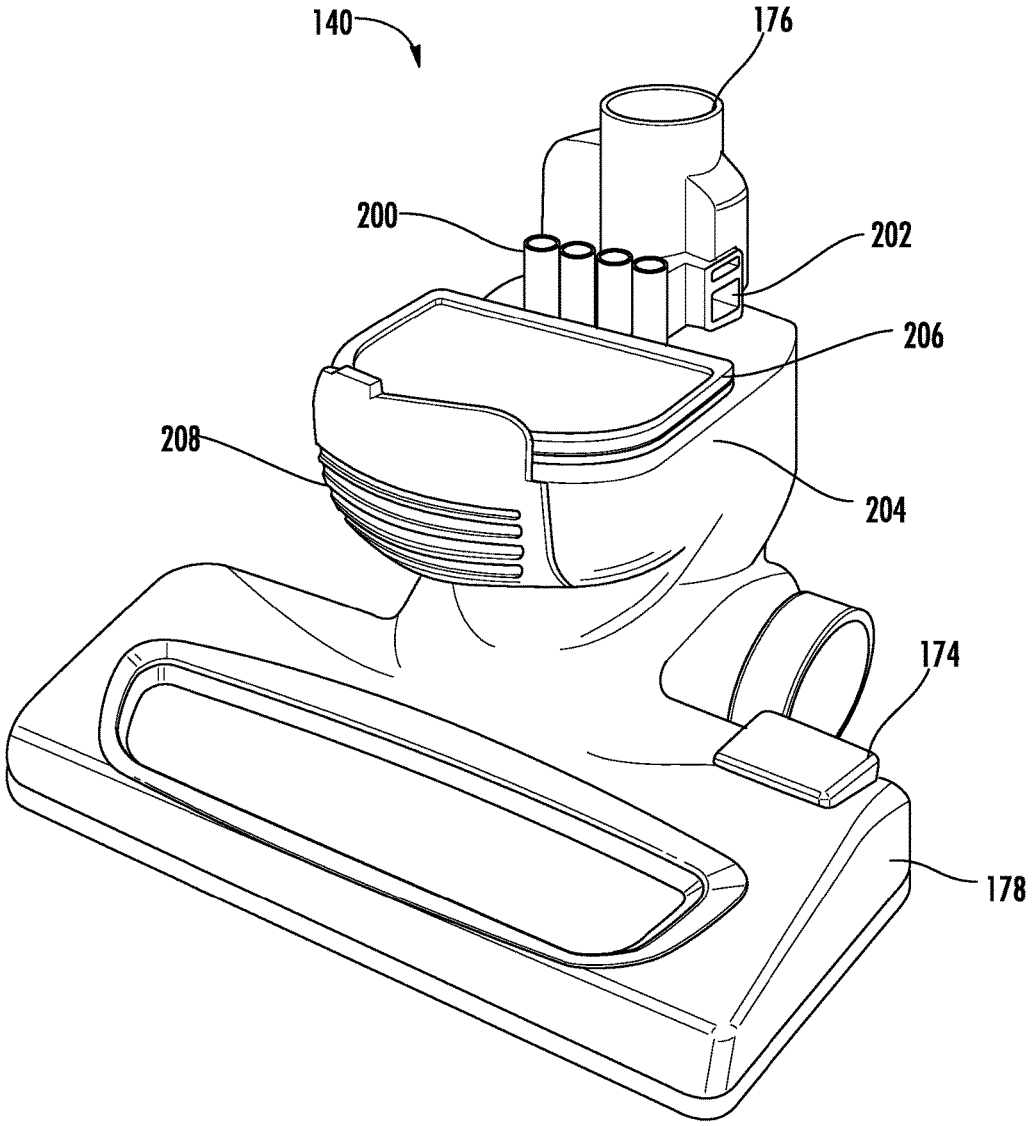
FIG. 14 is an isometric view of a vacuum cleaning head.

FIG. 14 shows the vacuum cleaning head 140 in more detail. Similar to the steam cleaning head 130, the tubular member 176 includes structure supporting an electrical connector 200, as well as a hollow 202 for receiving the above-mentioned latch element of the body 120 that mechanically secures the body 120 to the vacuum cleaning head 140. Extending from this structure is a bowl-shaped compartment 204 having a large opening at the top that receives a filter (such as a HEPA filter) 206, as well as a perforated front-facing grille 208. In operation, dirty air taken into the suction airway of the body 120 via the base 178 and tubular member 176 travels through the dust collector 123 (FIG. 10) and is forced downward through the filter 206 and out of the grille 208 as relatively clean exhaust air.

Figure 15:
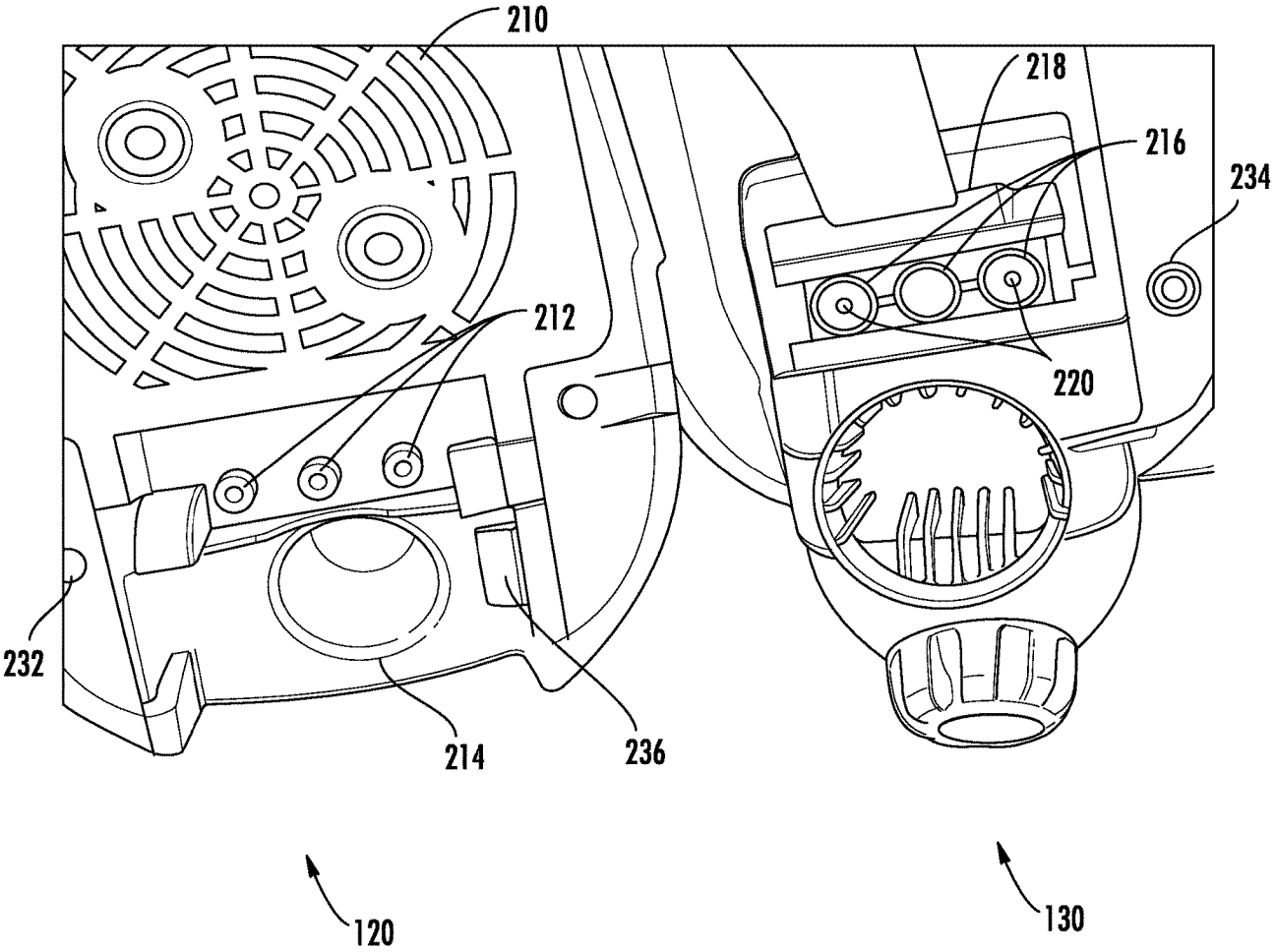
FIG. 15 is a close-up orthographic view of interface portions of a body and a steam cleaning head that mate with each other in a steam cleaner configuration.

FIG. 15 illustrates the mechanical and electrical interface between the lower end of the body 120 and the up-facing parts of the steam cleaning head 130. The lower end of the body 120 may be referred to as a cleaning-head interface. It includes a large flat section having perforations 210 for exhaust air in vacuum operation, described more below. The blower motor is mounted directly behind the perforations 210. The lower end of the body 120 also includes an electrical connector in the form of three insulated female electrical terminals 212, and the above-mentioned intake port 214 of the suction airway. The steam cleaning head 130 includes an electrical connector in the form of three insulated sockets or barrels 216 into which the terminals 212 of the body 120 are inserted when the body 120 is mated to the steam cleaning head 130. The sockets 216 are protected by a pivoting cover 218 that is displaced by the terminals 212 during mating. The cover 218 is shown in the open or displaced position. As shown, the outer two sockets 216 include male electrical terminals 220, while the middle socket 216 is unpopulated. As explained in more detail below, line and neutral electrical connections are made via the outer terminals 220 and corresponding outer terminals 212 of the body 120 to provide electrical power to the steam cleaning head 130. The inner terminal 212 of the body is left unconnected by virtue of the unpopulated middle socket 216.

Figure 16:
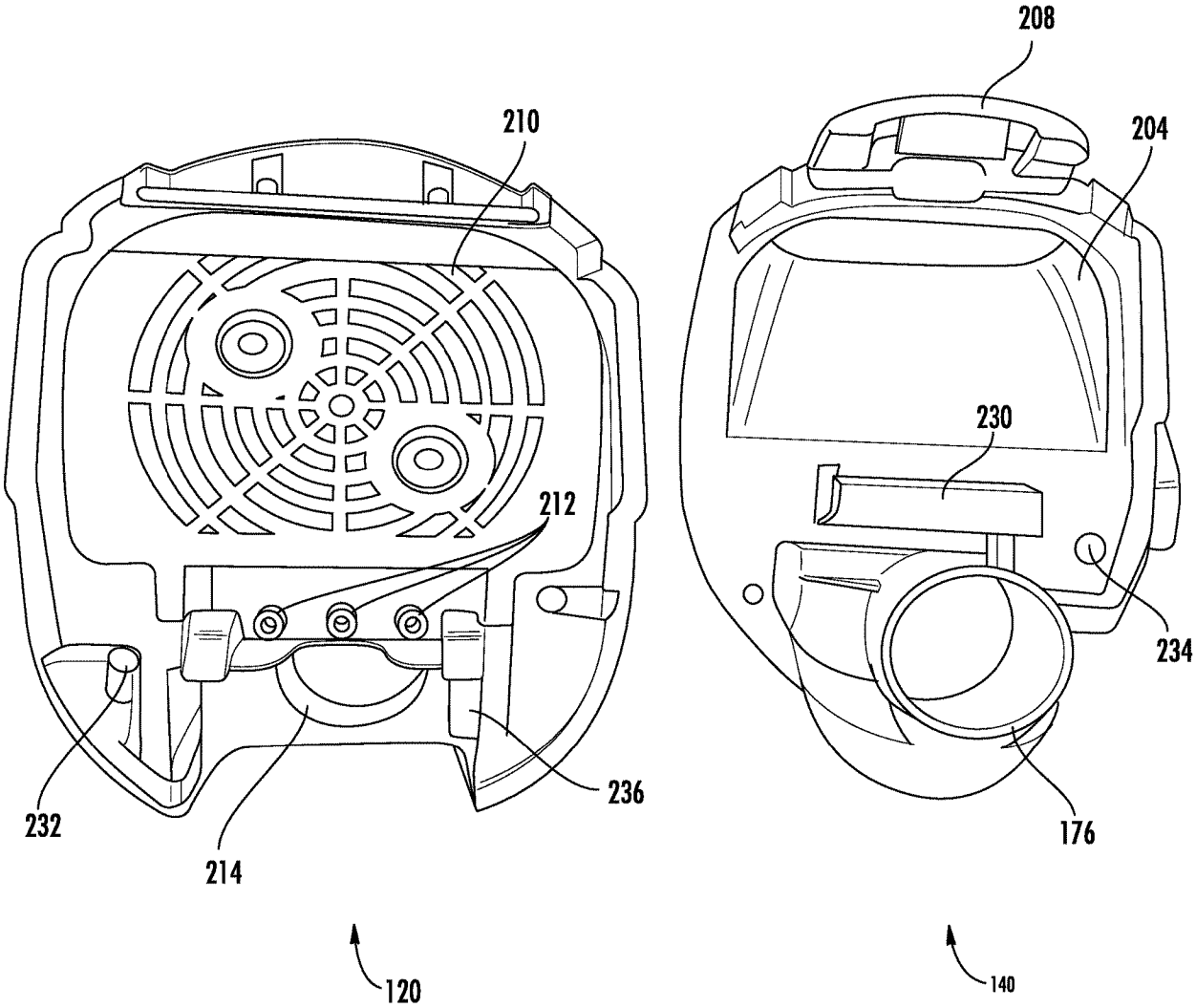
FIG. 16 is a close-up orthographic view of interface portions of a body and a vacuum cleaning head that mate with each other in a vacuum cleaner configuration.

FIG. 16 illustrates the mechanical and electrical interface between the lower end of the body 120 and the up-facing parts of the vacuum cleaning head 140. Similar to the steam cleaning head 130, the vacuum cleaning head 140 includes an electrical connector in the form of three insulated sockets or barrels (not visible in FIG. 16, generally identical to sockets 216 of FIG. 15 and covered by a pivoting cover 230 in FIG. 16), into which the terminals 212 of the body 120 are inserted when the body 120 is mated to the vacuum cleaning head 140. For the vacuum cleaning head 140, all three sockets include male electrical terminals. Similar to the steam cleaning head 130, line and neutral connections are made via the outer two terminals and corresponding outer terminals 212 of the body 120 to provide electrical power to the vacuum cleaning head 140. The inner terminal 212 of the body 120 has a connection to a terminal of the inner socket of the vacuum cleaning head 140 via which a neutral or return power connection is provided from the vacuum cleaning head 140 to the blower motor of the body 120. Thus, when the vacuum cleaning head 140 is attached to the body 120, this return connection is made and the blower motor is provided with electrical power for operation. The absence of this connection when the steam cleaning head 130 is attached to the body 120 breaks the electrical path and prevents operation of the blower motor.

Also shown in FIG. 16 is the above-discussed perforated front-facing grille 208 and the bowl-shaped compartment 204, in this case with the filter 206 (FIG. 14) removed to reveal the inner space. In operation, dirty air travels into the space of compartment 204 via the filter 206 and exits through the perforations of the grille 208 as relatively clean exhaust air.

Also visible in FIGS. 15-16 is a microswitch 232 functioning as a power cutout switch that cuts off electrical power when in the open or extended position, as it is in FIG. 16. When either the steam cleaning head 130 or vacuum cleaning head 140 is attached to the body, the microswitch 232 is depressed to a closed position, in which the power connection is made and electrical power can flow to the unit. As the outer edge of the body 120 is slightly raised with respect to the rest of the bottom surface shown in FIGS. 15 and 16, the microswitch 232 is protected against inadvertent depressing (and closing) when the body 120 is placed on a flat surface such as shown in FIG. 8, preventing operation of the blower motor. Both the steam cleaning head 130 and vacuum cleaning head 140 include short post-like members 234 that depress the microswitch 232 to the closed position when either cleaning head is attached to the body 120.

Also shown in FIGS. 15 and 16 is the latch element 236 that engages the hollow 192, 202 (FIGS. 13-14) to secure the steam cleaning head 130 and vacuum cleaning head 140 respectively to the body 120.

Figure 17:
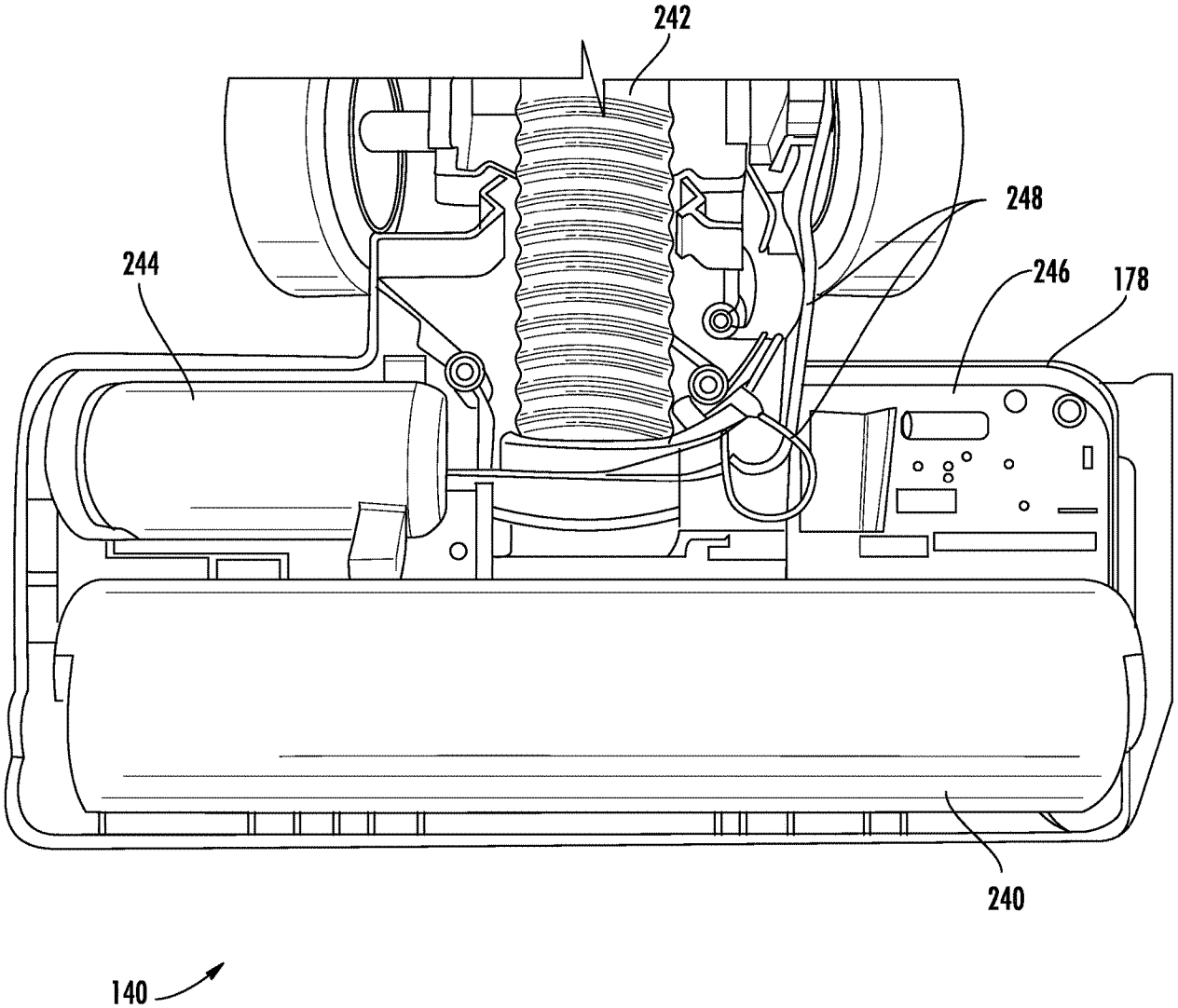
FIG. 17 is a top orthographic view of the interior of a base of a vacuum cleaning head.

FIG. 17 shows a configuration of components inside the base 178 of the vacuum cleaning head 140. In this view, the tubular member 176 is pivoted rearward, which is toward the top in FIG. 17. The vacuum cleaning head 140 includes a beater bar assembly 240 coupled to a flexible hose 242 that terminates at the tubular member 176 (not visible in FIG. 17). Also shown are a beater motor 244 and electrical control circuitry 246, as well as wiring 248 extending from these components up to the connector 200 (FIG. 14) via a passage in the structure extending from tubular member 176.

Figure 18:
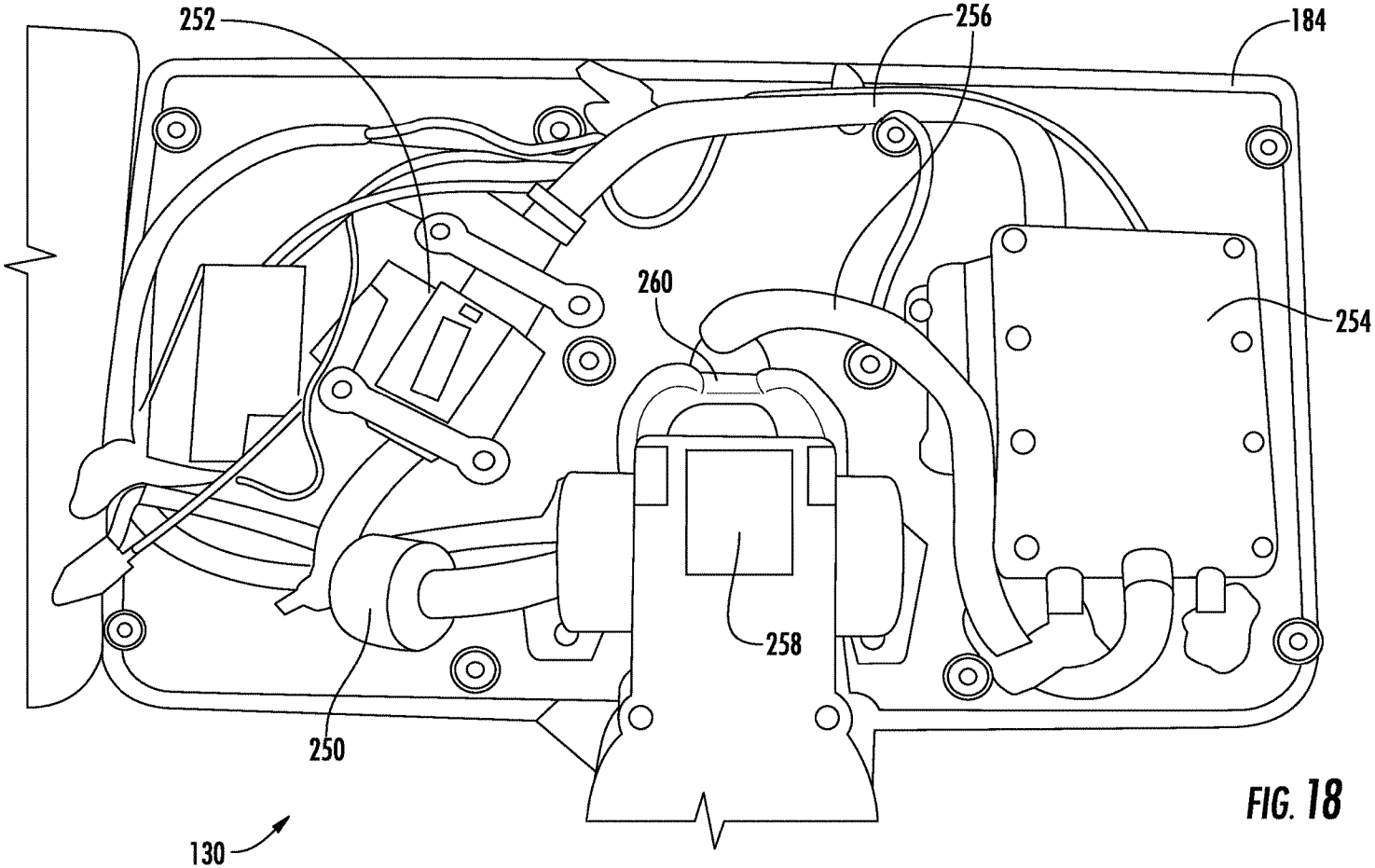
FIG. 18 is a top orthographic view of the interior of a base of a steam cleaning head.

FIG. 18 shows a configuration of components inside the base 184 of the steam cleaning head 140. In this view, the tubular member 182 is pivoted rearward, which is toward the bottom in FIG. 18. The base 184 includes a filter 250, pump 252, and steam generator or boiler 254 connected together by flexible conduit 256. Water from the tank 194 (FIG. 13) travels through the filter 250 and the pump 252 to enter the steam generator 254, where it is converted into steam that travels via an outlet conduit 256 to surface-facing outlet openings in a bottom plate of the base 184. As mentioned above, a pad may be disposed on the bottom plate to effect wiping or scrubbing as well as steam/water distribution over a surface during use.

Also shown in FIG. 18 is a cutout switch 258 that is engaged by a protrusion 260 from the bottom plate. The cutout switch 258 may be a normally closed switch that is opened 1,5 when the tubular member 182 is in a fully upright position, turning off the pump 252 and steam generator 254.

Figure 19:
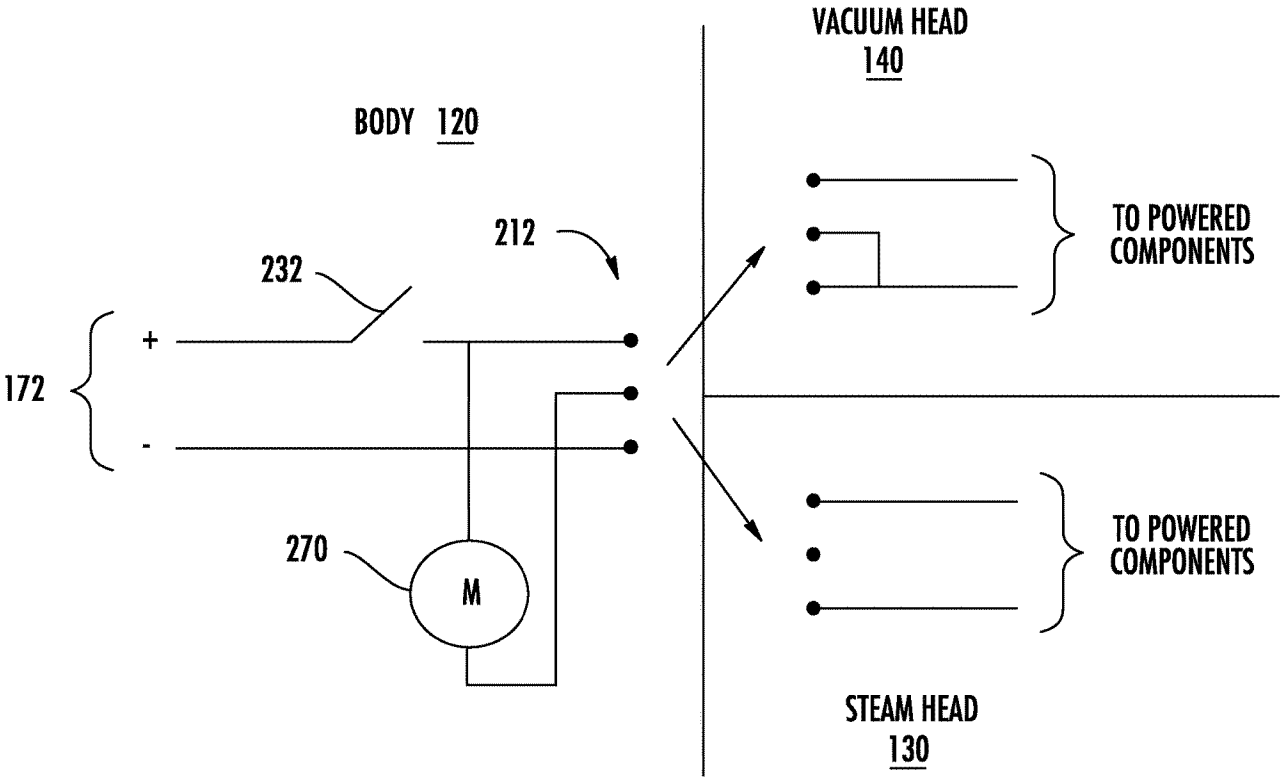
FIG. 19 is a schematic diagram of electrical connections formed in the multifunctional cleaning system.

FIG. 19 is a simplified schematic diagram of the electrical connections made via the various terminals 212, 216, etc. as discussed above. The body side receives incoming line (+) and neutral (−) wires of power cord 172, and the line wire is connected through the microswitch 232 to one outer terminal 212 as well as to one side of the blower motor 270. Neutral (−) is connected to the other outer terminal 212. The return side of the blower motor 270 is connected to the inner terminal 212. On the steam cleaning head 130, wiring connections are made to only the outer terminals 220 to enable electrical power to flow to the internal components such as pump 252 and steam generator 254 (FIG. 18). On the vacuum cleaning head 140, similar wiring connections are made to the outer two terminals to enable electrical power to flow to the internal components such as the beater bar assembly 240 (FIG. 17), and in addition a connection is made between the neutral outer terminal and the inner terminal as shown. This connection completes a circuit for electrical current to flow through the blower motor 270 for motor operation, namely a circuit from the line (+) wire, through the blower motor 270 to the inner terminal of the vacuum cleaning head 140, then through the connection within the vacuum cleaning head 140 to the neutral outer terminal and the neutral (−) wire.

While various embodiments of the invention have been particularly shown and described, it will be understood by those skilled in the art that various changes in form and details may be made therein without departing from the scope of the invention as defined by the appended claims.

What is claimed is:

1. A multi-functional cleaning system, comprising:

a body including a suction airway and a blower motor for drawing air through the suction airway, the suction airway extending to a suction opening at a cleaning head interface of the body, the cleaning head interface including a latch element of a user-operated latch and a first electrical connector, the body further including wiring for supplying externally provided electrical power to terminals of the first electrical connector;

a vacuum cleaning head releasably coupleable to the cleaning head interface of the body by the latch element, the vacuum cleaning head including a surface-interface portion and a body-interface portion, the body-interface portion sealingly coupleable to the suction opening of the cleaning head interface of the body to provide vacuuming suction to the surface-interface portion for vacuum cleaning;

a steam cleaning head releasably coupleable to the cleaning head interface of the body by the user-operated latch, the steam cleaning head including a surface-interface portion, an electrically powered steam generator, and a body interface portion including a second electrical connector configured for mating with the first electrical connector to deliver the electrical power to the steam generator, the steam cleaning head further including a steam delivery passage configured to deliver steam from the steam generator to the surface-interface portion of the steam cleaning head for steam cleaning, wherein:

the first electrical connector includes a set of outward-extending insulated female terminals;

the second electrical connector includes a set of sockets for receiving the insulated female terminals of the first electrical connector, the second electrical connector further including a pivoting cover actuated from a closed position into an open position by insertion of the insulated female terminals into the sockets, the pivoting cover covering the sockets in the closed position and uncovering the sockets in the open position; and the vacuum cleaning head includes a beater bar assembly and a third electrical connector configured for mating with the first electrical connector to deliver the electrical power to the beater bar assembly.

2. A multi-functional cleaning system, comprising:

a body including a suction airway and a blower motor for drawing air through the suction airway, the suction airway extending to a suction opening at a cleaning head interface of the body, the cleaning head interface including a latch element of a user-operated latch and a first electrical connector, the body further including wiring for supplying externally provided electrical power to terminals of the first electrical connector;

a vacuum cleaning head releasably coupleable to the cleaning head interface of the body by the latch element, the vacuum cleaning head including a surface-interface portion and a body-interface portion, the body-interface portion sealingly coupleable to the suction opening of the cleaning head interface of the body to provide vacuuming suction to the surface-interface portion for vacuum cleaning;

a steam cleaning head releasably coupleable to the cleaning head interface of the body by the user-operated latch, the steam cleaning head including a surface-interface portion, an electrically powered steam generator, and a body interface portion including a second electrical connector configured for mating with the first electrical connector to deliver the electrical power to the steam generator, the steam cleaning head further including a steam delivery passage configured to deliver steam from the steam generator to the surface-interface portion of the steam cleaning head for steam cleaning, wherein:

the first electrical connector includes a set of outward-extending insulated female terminals;

the second electrical connector includes a set of sockets for receiving the insulated female terminals of the first electrical connector, the second electrical connector further including a pivoting cover actuated from a closed position into an open position by insertion of the insulated female terminals into the socket, the pivoting cover covering the sockets in the closed position and uncovering the sockets in the open position;

the vacuum cleaning head includes a beater bar assembly and a third electrical connector configured for mating with the first electrical connector to deliver the electrical power to the beater bar assembly; wherein:

the blower motor receives the electrical power via a line connection and a motor neutral connection, line connection wired in the body to a line input, the motor neutral connection being wired in the body to one terminal of the first electrical connector;

the vacuum cleaning head includes wiring forming a connection between a neutral power input and a terminal of the second electrical connector corresponding to the one terminal of the first electrical connector to provide a path for electrical current through the blower motor; and the steam cleaning head does not include a connection between the neutral power input and the terminal of the second electrical connector corresponding to the one terminal of the first electrical connector and does not provide the path for electrical current through the blower motor.

3. A multi-functional cleaning system comprising:

a body including a suction airway and a blower motor for drawing air through the suction airway, the suction airway extending to a suction opening at a cleaning head interface of the body, the cleaning head interface including a latch element of a user-operated latch and a first electrical connector, the body further including wiring for supplying externally provided electrical power to terminals of the first electrical connector;

a vacuum cleaning head releasably coupleable to the cleaning head interface of the body by the latch element, the vacuum cleaning head including a surface-interface portion and a body-interface portion, the body-interface portion sealingly coupleable to the suction opening of the cleaning head interface of the body to provide vacuuming suction to the surface-interface portion for vacuum cleaning;

a steam cleaning head releasably coupleable to the cleaning head interface of the body by the user-operated latch, the steam cleaning head including a surface-interface portion, an electrically powered steam generator, and a body interface portion including a second electrical connector configured for mating with the first electrical connector to deliver the electrical power to the steam generator, the steam cleaning head further including a steam delivery passage configured to deliver steam from the steam generator to the surface-interface portion of the steam cleaning head for steam cleaning, wherein:

the first electrical connector includes a set of outward-extending insulated female terminals;

the second electrical connector includes a set of sockets for receiving the insulated female terminals of the first electrical connector, the second electrical connector further including a pivoting cover actuated from a closed position into an open position by insertion of the insulated female terminals into the sockets, the pivoting cover covering the sockets in the closed position and uncovering the sockets in the open position; and the vacuum cleaning head includes a beater bar assembly and a third electrical connector configured for mating with the first electrical connector to deliver the electrical power to the beater bar assembly, wherein the body further includes a power cutout switch for interrupting the flow of power to the blower motor and the first electrical connector, the power cutout switch located at the cleaning head interface and being actuated into a closed position to enable the flow of power when the body is attached to either one of the steam cleaning head and the vacuum cleaning head, the power cutout switch being mechanically shielded so as to prevent inadvertent actuation into the closed position when the body is not attached to either one of the steam cleaning head and the vacuum cleaning head.

* * * * *